US009057290B2

(12) United States Patent
Manther et al.

(10) Patent No.: US 9,057,290 B2
(45) Date of Patent: Jun. 16, 2015

(54) SWITCHING ROLLER FINGER FOLLOWER WITH LOCKING MECHANISM

(71) Applicant: Schaeffler Technologies GmbH & Co. KG, Herzogenaurach (DE)

(72) Inventors: Debora Manther, Royal Oak, MI (US); Kevin Poole, Northville, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/160,144

(22) Filed: Jan. 21, 2014

(65) Prior Publication Data

US 2014/0209048 A1 Jul. 31, 2014

Related U.S. Application Data

(60) Provisional application No. 61/757,489, filed on Jan. 28, 2013.

(51) Int. Cl.

| | |
|---|---|
| ***F01L 1/34*** | (2006.01) |
| ***F01L 1/18*** | (2006.01) |
| ***F01L 13/00*** | (2006.01) |

(52) U.S. Cl.

CPC . *F01L 1/18* (2013.01); *F01L 1/185* (2013.01); *F01L 13/0005* (2013.01); *F01L 13/0015* (2013.01); *F01L 2001/186* (2013.01); *F01L 2105/00* (2013.01)

(58) Field of Classification Search

CPC ..... F01L 1/18; F01L 1/185; F01L 13/0015; F01L 13/0005; F01L 2105/00; F01L 2001/186

USPC ..... 123/90.16, 90.39

See application file for complete search history.

(56) References Cited

U.S. PATENT DOCUMENTS

| | | | | |
|---|---|---|---|---|
| 2003/0200947 | A1* | 10/2003 | Harris | 123/90.43 |
| 2008/0141964 | A1 | 6/2008 | Ha et al. | |
| 2008/0223324 | A1 | 9/2008 | Ng | |
| 2010/0300389 | A1 | 12/2010 | Manther et al. | |
| 2011/0023806 | A1 | 2/2011 | Heinemann | |
| 2011/0226208 | A1 | 9/2011 | Zurface et al. | |

OTHER PUBLICATIONS

International Search Report for PCT/US2014/012755, mailed Oct. 13, 2014 by Korean Intellectual Property Office.

* cited by examiner

*Primary Examiner* — Zelalem Eshete

(74) *Attorney, Agent, or Firm* — Simpson & Simpson, PLLC

(57) ABSTRACT

A switching roller finger follower, including: first and second rotatable outer arms; and a locking mechanism including a locking pin with a first outside diameter and first and second ends. The locking mechanism includes first and second locking sleeves: separate from the locking pin; fixedly secured to the first and second ends, respectively; and having second and third outside diameters, respectively, larger than the first outside diameter. The locking pin is displaceable such that: in a locked mode, the first and second locking sleeves contact the first and second outer arms, respectively, to block rotation of the first and second outer arms in a first rotational direction; and in an unlocked mode, the first and second locking sleeves are free of contact with the first and second outer arms, respectively.

18 Claims, 6 Drawing Sheets

SWITCHING ROLLER FINGER FOLLOWER WITH LOCKING MECHANISM

CROSS-REFERENCE TO RELATED APPLICATIONS

This application claims the benefit under 35 U.S.C. §119 (e) of U.S. Provisional Patent Application No. 61/757,489, filed Jan. 28, 2013, which application is incorporated herein by reference in its entirety.

TECHNICAL FIELD

The present disclosure relates to a switching roller finger follower with a locking mechanism for use with a valve train of an internal combustion engine. In particular the locking mechanism includes locking sleeves with diameters selectable to control lash between a locking pin and outer arms contacting cam lobes.

BACKGROUND

A switching roller finger follower is used to control a valve in a valve train for an internal combustion engine. Arms for the follower are pivotably connected to a housing for the follower and positioned to enable contact with various lobes on a cam shaft. An element, such as a pin, in the follower is displaceable such that the element is either in a locked or an unlocked position with respect to the arms. In the locked position, respective ends of the element are aligned with respective arms such that when respective cam lobes contact the arms to pivot the arms, the arms engage the respective ends of the element. Since the engagement of the arms with the respective ends of the element locks the housing to the arms, the motion of the cam lobes is transferred to the housing to pivot the housing to operate (open and close) the valve. At the onset of the locked mode, when the respective ends of the element are aligned with the arms, but before the cam lobes begin to pivot the arms toward the elements, there is a gap, or lash, between the respective ends of the element and the arms. However, the dimensions of the respective ends of the element, such as the diameter, are subject to manufacturing and tolerance variations. Therefore, there is typically an unpredictable variation in the lash between the respective ends of the element and the outer arms for a single finger follower.

The same manufacturing and tolerance variations can causing varying amounts of unpredictable lash among finger followers in a production run of finger followers. The design of components for a cam shaft interfacing with the finger follower is impacted by the lash in the follower, for example, the design can optimize dimensions or configurations of components according to an expected lash. However, due to the unavoidable manufacturing and tolerance variations noted above, respective lash for individual followers in the production run cannot be predicted. As a result, the design of the components noted above must accommodate a larger range of possible lash dimensions, preventing optimization of the design.

Ideally, the lash for a finger follower would be as small as possible and would be identical for both ends of the element. However, due to the manufacturing and tolerance variations noted above, it is not possible to control the lash more tightly or predictably than within the range of the manufacturing and tolerance variations. That is, once the elements are installed, the lash variation is fixed and cannot be altered. Increased lash slows operation of the finger follower by requiring more time for the cam lobes to pivot the housing (operate the valve), since the amount of pivoting of the arm by the cam lobes to contact the elements and begin pivoting of the housing is increased. When the lash between the respective elements and arms is different, one cam lobe causes one of the arms to more quickly engage a respective end of the element than another cam lobe causes the other arm to engage the other end of the element, which can adversely affect operation of the finger follower.

In an unlocked mode, the respective ends of the element are misaligned with the arms, and the arms are free to pivot without contacting the elements. Thus, when the respective cam lobes on the cam shaft contact the outer arms, the arms pivot to accommodate the contact with the cam lobes and a position of the housing is not modified due to the contact between the cam lobes and the arms. In general, another cam contacts a different point, for example, the bearing, on the follower to displace the follower to operate the valve when the arms are in the unlocked mode.

To secure the element to the follower, retaining devices are affixed to ends of the element. In general, additional fabricating steps must be performed to provide features or profiles on the element to accommodate the retaining devices. For example, machined grooves are added to the ends to receive retaining rings. The extra fabricating steps and components add to the cost and complexity of the follower.

SUMMARY

According to aspects illustrated herein, there is provided a switching roller finger follower, including: first and second rotatable outer arms; and a locking mechanism including a locking pin with a first outside diameter and first and second ends. The locking mechanism includes first and second locking sleeves: separate from the locking pin; fixedly secured to the first and second ends, respectively; and having second and third outside diameters, respectively, larger than the first outside diameter. The locking pin is displaceable such that: in a locked mode, the first and second locking sleeves contact the first and second outer arms, respectively, to block rotation of the first and second outer arms in a first rotational direction; and in an unlocked mode, the first and second locking sleeves are free of contact with the first and second outer arms, respectively.

According to aspects illustrated herein, there is provided a switching roller finger follower, including: an inner housing with a space at least partially formed by first and second side walls, a locking barrel with a passageway including a sealed first end and a second end opening into the space, and first and second slots passing through material forming the first and second side walls, respectively; and first and second outer arms pivotably connected to the first and second side walls, respectively. The follower includes a locking mechanism with: a shuttle pin at least partially disposed in the passageway, including a notch disposed in the space, and displaceable within the passageway in a direction parallel to a longitudinal axis for the passageway; a locking pin including a first outside diameter, passing through the first and second slots and at least partly disposed in the notch, displaceable within the first and second slots, and including first and second ends extending past the first and second side walls, respectively; and first and second locking sleeves separately formed from the locking pin, fixedly secured to the first and second ends, respectively, having second and third outside diameters, respectively, and aligned with the first and second outer arms, respectively, in a direction orthogonal to a longitudinal axis for the locking pin.

According to aspects illustrated herein, there is provided a method of fabricating a switching roller finger follower, including: pivotably connecting first and second outer arms to an inner housing; disposing a shuttle pin, including a portion with a notch, within a passageway formed by the inner housing; disposing the notch within a space at least partly formed by the inner housing; disposing a locking pin, with a first outside diameter, in first and second slots in the inner housing; passing a portion of the locking pin through the notch; extending first and second ends of the locking pin past the inner housing; selecting second and third outside diameters for first and second locking sleeves, respectively, the second and third outside diameters greater than the first outside diameter; fixedly securing the first and second locking sleeves to the first and second ends of the locking pin, respectively; and aligning the first and second locking sleeves with the first and second outer arms, respectively, in a first direction orthogonal to a longitudinal axis for the locking pin.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
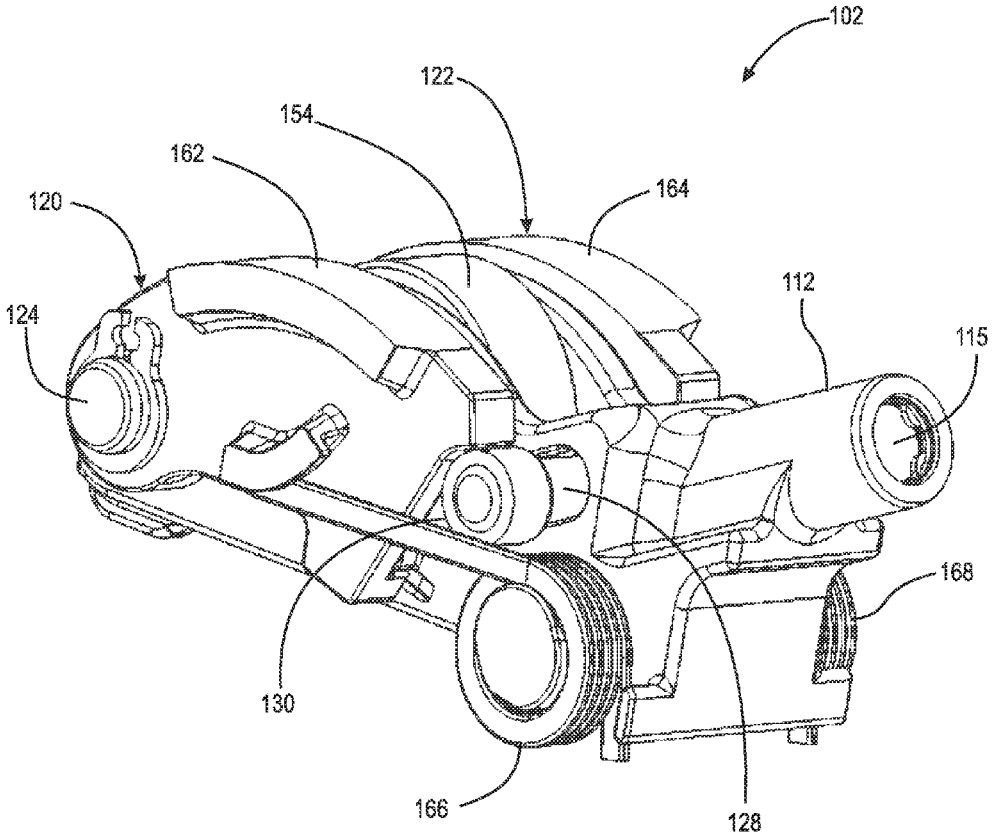
FIG. 1 is a perspective front view of a switching roller finger follower with a locking mechanism in a locked mode.

FIG. 1 is a perspective front view of a switching roller finger follower with locking mechanism 100 in a locked mode.

Figure 2:
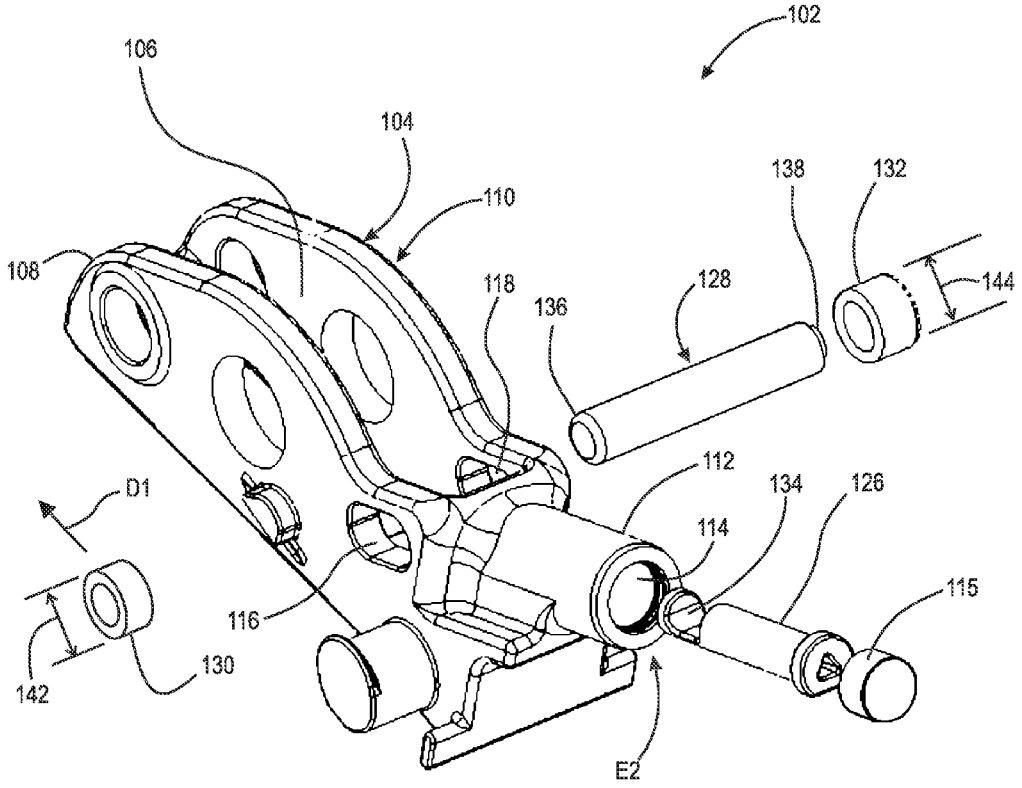
FIG. 2 is a perspective exploded view of an inner housing and locking mechanism for the switching roller finger follower of FIG. 1.

FIG. 2 is a perspective exploded view of an inner housing and locking mechanism 100 for the switching roller finger follower of FIG. 1.

Figure 3:
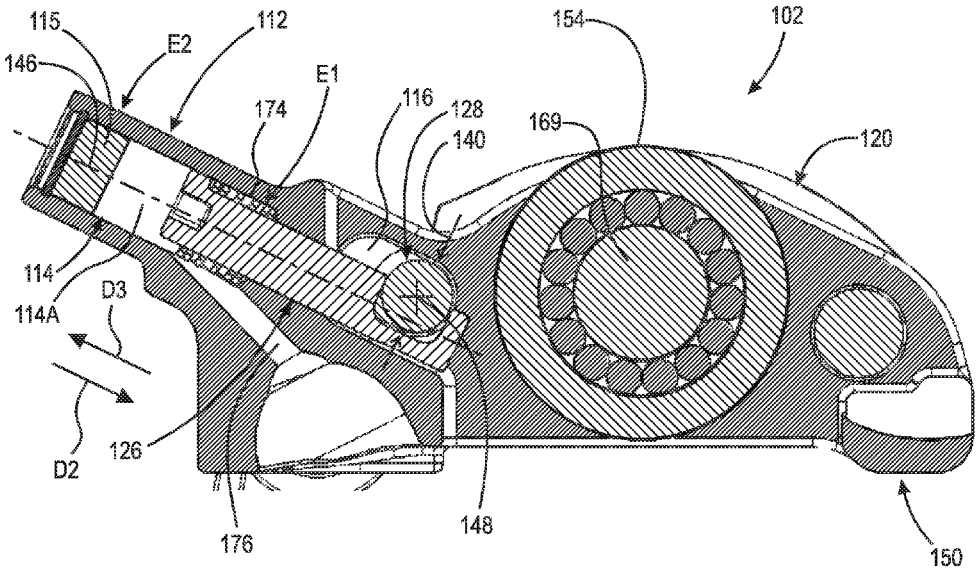
FIG. 3 is a cross-sectional view of the switching roller finger follower with locking mechanism of FIG. 1 in a locked mode.

FIG. 3 is a cross-sectional view of the switching roller finger follower with locking mechanism 100 of FIG. 1 in a locked mode.

Figure 4:
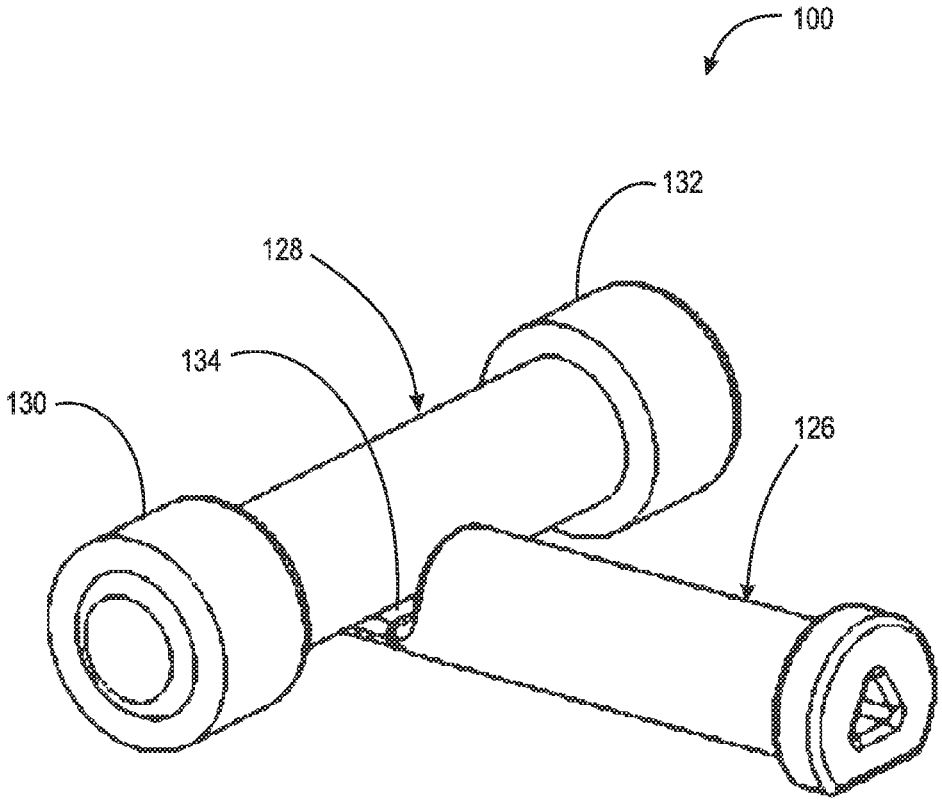
FIG. 4 is a detail showing a locking pin and shuttle pin for the locking mechanism of FIG. 1.

FIG. 4 is a detail showing a locking pin and shuttle pin for locking mechanism 100 of FIG. 1. The following should be viewed in light of FIGS. 1 through 4. Switching roller finger follower 102 includes locking mechanism 100 and inner housing 104 with space 106 at least partially formed by the inner housing, for example, by side walls 108 and 110 of the housing. The inner housing includes locking barrel 112 with passageway 114. End E1 of the passageway opens into the space and end E2 is sealed, for example, by seal 115. The inner housing includes slots 116 and 118 passing through material forming the inner housing, for example, material forming side walls 108 and 110, respectively. The follower includes outer arms 120 and 122 pivotably connected to the inner housing, for example, at side walls 108 and 110, respectively. In an example embodiment, pin 124 is used to connect the arms to the inner housing.

The locking mechanism includes shuttle pin 126, locking pin 128, and locking sleeves 130 and 132. The shuttle pin is at least partially disposed in the passageway and includes notch 134 disposed in the space. The locking pin is disposed in, that is, passes through, slots 116 and 118 and is at least partly disposed in the notch. The locking pin includes ends 136 and 138 extending past side walls 108 and 110, respectively, and has an outside diameter 140. The locking sleeves are separate respective elements from the locking pin. Sleeve 130 is fixedly secured to end 136 and sleeve 132 is fixedly secured to end 138. Sleeves 130 and 132 have respective outside diameters 142 and 144.

The shuttle pin is displaceable along longitudinal axis 146 for the passageway to displace the locking pin as further described below. The locking pin includes longitudinal axis 148. To enable contact of the locking sleeves with outer arms 120 and 122, for example, as shown in FIG. 1, locking sleeves 130 and 132 are aligned with outer arms 120 and 122, respectively, in direction D1 orthogonal to axis 148. Slots 116 and 118 are sized to enable movement of the locking pin in directions D2 and D3, substantially parallel to axis 146.

In a locked mode, as shown in FIGS. 1 and 2, locking sleeves 130 and 132 are in contact with arms 120 and 122, respectively. As further described below, the contact of the sleeves and the arms fixes the arms with respect to the inner housing.

Figure 5:
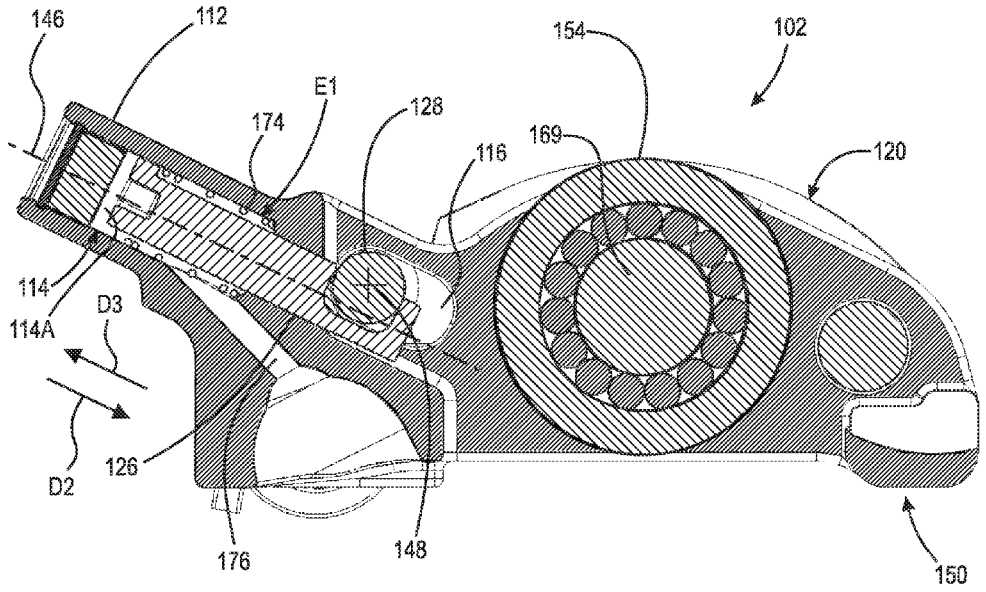
FIG. 5 is a cross-sectional view of the switching roller finger follower with locking mechanism of FIG. 1 in an unlocked mode; and, FIG. 6 is a perspective view of the switching roller finger follower with locking mechanism of FIG. 1 in an unlocked mode and connected to a valve train.

FIG. 5 is a cross-sectional view of switching roller finger follower 102 with locking mechanism 100 of FIG. 1 in an unlocked mode. In the unlocked mode, the displacement of the locking pin causes locking sleeves 130 and 132 to move out of alignment with outer arms 120 and 122, respectively. As further described below, the misalignment of the sleeves and subsequent lack of contact of the sleeves and the arms enables the arms to pivot with respect to the inner housing.

As noted above, lash is the amount of gap between, for example, sleeves 130 and 132 and outer arms 120 and 122 at the onset of the locked mode, caused by manufacturing and assembly variations. Also as noted above, the amount of lash helps determine the speed of operation of the follower, specifically; reducing the lash enables faster operation of the follower as further described below. As noted above, unequal lash for the two sides of a finger follower can adversely affect operation of the finger follower. Advantageously, diameters 142 and 144 are selectable to provide a predetermined amount of lash, to reduce or eliminate an undesirable amount of lash, and/or to equalize lash in response to tolerance variations associated with manufacture or assembly of the locking pin, the inner housing, or the outer arms.

For example, a determination is made as to the actual distance between the locking pin and the outer arms when the locking pin is installed in the locked mode. Diameters 142 and 144 are sized such that sleeves 130 and 132 take up as much of the actual distance as possible, such that a predetermined amount of distance is left between the sleeves and the outer arms in the locked mode, and/or lash for sleeves 130 and 132 is equal. Thus, lash is reduced or equalized to the greatest extent possible and/or to a predetermined amount. As a result, the speed of operation of follower 102 or the predictability and repeatability of the operation of follower 102 is increased to the greatest extent possible, while minimizing possible adverse affects due to unequal lash. Also, since diameters 142 and 144 are selectable to such that lash is known and predictable, the design of components for a camshaft interfacing with follower 102 can be optimized according to the known and predictable lash.

In an example embodiment, outside diameters 142 and 144 are the same. In an example embodiment, outside diameter 142 is different from outside diameter 144. Thus, lash can be individually adjusted for each sleeve/outer arm pair.

Figure 6:
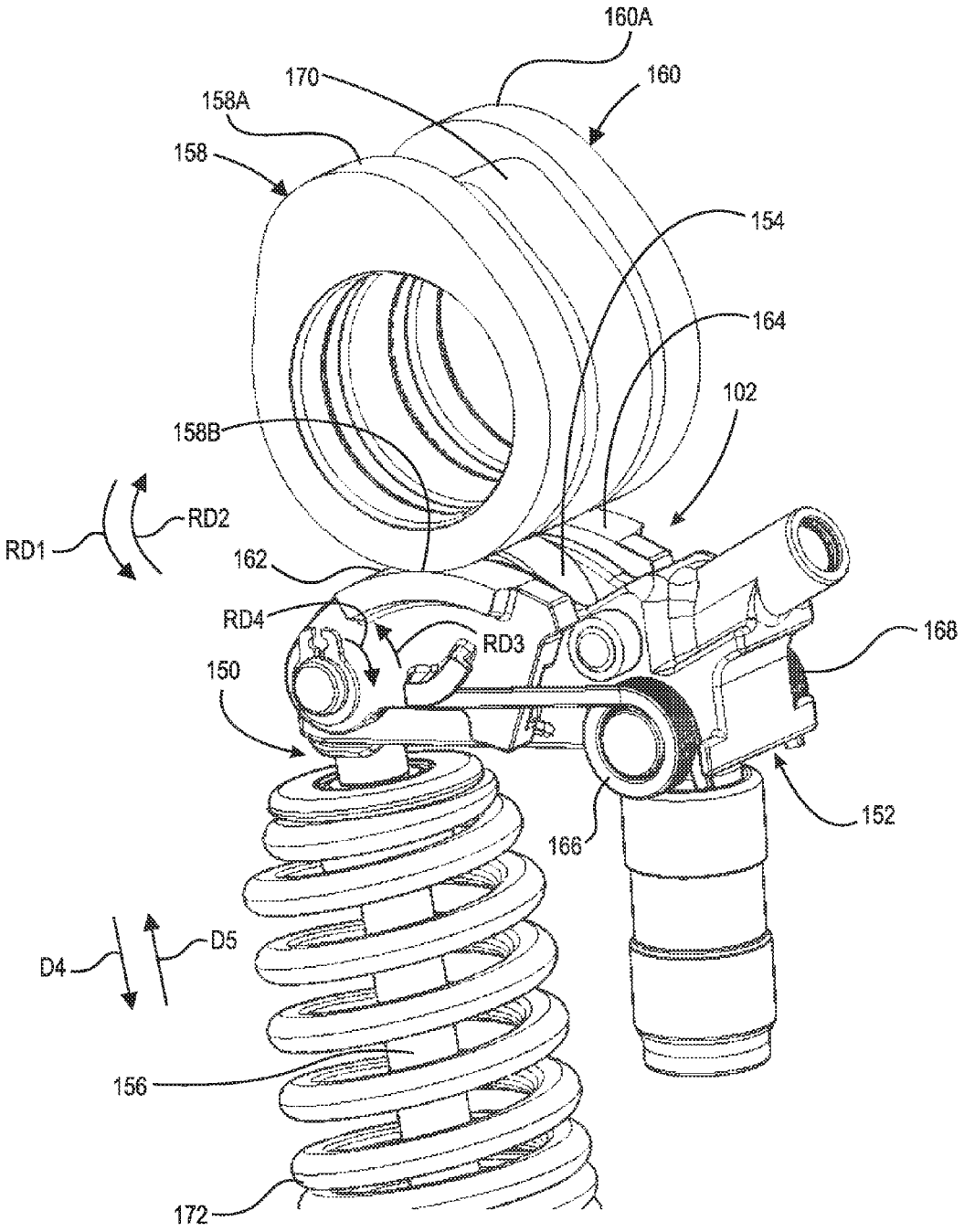

FIG. 6 is a perspective view of switching roller finger follower 102 with locking mechanism 100 of FIG. 1 in an unlocked mode and connected to a valve train. The following should be viewed in light of FIGS. 1 through 6. Follower 102 includes contact surface 150 and attachment portion 152 arranged to pivotably connect the inner housing to a support element. In an example embodiment, the follower includes bearing 154. The contact surface is arranged to contact valve stem 156. In the locked mode, cam lobes 158 and 160 of a cam shaft (not shown) for a valve train, including valve stem 156, are arranged to contact outer arms 120 and 122, in particular contact surfaces 162 and 164, respectively. Since the outer arms are locked in place by the sleeves, the pressure applied by the cam lobes causes the follower to pivot in direction RD1 with respect to portion 152. Via contact surface 150, the follower pushes the stem in direction D4, for example, to open a valve including the valve stem. A greatest amount of pivoting of follower 102 occurs when portions 158A and 160A are in contact with surfaces 162 and 164, respectively.

When the cam lobes rotate further, for example from portion 158A to portion 158B contacting surface 162, spring 172 is able to pivot follower 102 in direction RD2. Springs 166 and 168 urge arms 120 and 122 in rotational direction RD3 to maintain contact between outer arms 120 and 122 and cams 158 and 160, respectively In the unlocked mode, when the cam lobes contact the outer arms, the arms are free to pivot about pin 124, for example, in direction RD4. Thus, the contact between the cam lobes and the outer arms is accommodated by the pivoting such that contact between the cam lobes and the outer arms does not cause the housing to displace with respect to the support element. Therefore, the cam lobes do not cause the follower to operate the valve. Springs 166 and 168 urge arms 120 and 122, respectively, in direction RD3 to ensure that arms 120 and 122 are in position to receive sleeves 130 and 132, respectively, for the locking mode.

In an example embodiment, a different cam lobe, for example cam lobe 170, is arranged to contact the bearing (which is rotational with respect to the inner housing, but otherwise fixed to the housing, for example by pin 169) such that the contact of cam lobe 170 with the bearing causes the follower to pivot in direction RD1 with respect to the support element to push the valve stem in direction D4. In an example embodiment, in the absence of force applied by the follower to the valve stem in direction D4, spring 172 urges the valve stem in direction D5. The operation of cam lobes 158, 160, and 170 vary the height to which valve 156 is opened during operation.

Returning to FIGS. 3 and 5, the shuttle pin is operated as is known in the art. For example, spring 174 is located in space 106 and in contact with the shuttle pin. The spring urges the shuttle pin in direction D3. Port 176 is used to supply and remove pressurized fluid in portion 114A of the space. When pressurized fluid is present in portion 114A, the fluid forces the shuttle pin in direction D2 such that the locking pin is shifted to the locked mode. When pressurized fluid is absent from portion 114A, the spring forces the shuttle pin in direction D3 such that the locking pin is shifted to the unlocked mode.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A switching roller finger follower, comprising:
first and second rotatable outer arms; and,
a locking mechanism including:
a locking pin including:
a first outside diameter; and,
first and second ends; and,
first and second locking sleeves:
separate from the locking pin;
fixedly secured to the first and second ends, respectively; and,
having second and third outside diameters, respectively, larger than the first outside diameter, wherein the locking pin is displaceable such that:
in a locked mode, the first and second locking sleeves contact the first and second outer arms, respectively, to block rotation of the first and second outer arms in a first rotational direction; and,
in an unlocked mode, the first and second locking sleeves are free of contact with the first and second outer arms, respectively.

2. The switching roller finger follower of claim 1 further comprising:
an inner housing including:
a space at least partially enclosed by the inner housing;
a locking barrel with a passageway including a sealed first end and a second end opening into the space; and,
first and second slots, wherein:
the locking mechanism includes a shuttle pin partially disposed in the passageway and including a notch disposed in the space;
the locking pin is disposed in the first and second slots and passes through the notch;
the first and second ends extend past the inner housing; and,
the first and second outer arms are pivotably connected to the inner housing.

3. The switching roller finger follower of claim 1, wherein the second outside diameter is different from the third outside diameter.

4. The switching roller finger follower of claim 1, wherein the second outside diameter is equal to the third outside diameter.

5. The switching roller finger follower of claim 1, wherein:
the locking pin includes a longitudinal axis; and, the first and second locking sleeves are aligned with the first and second outer arms, respectively, in a direction orthogonal to the longitudinal axis.

6. The switching roller finger follower of claim 1, wherein:

in the locked mode:

the shuttle pin is in a first position within the passageway;

the first and second outer arms are arranged to contact first and second cam lobes from a plurality of cam lobes; and, the first and second outer arms are arranged to remain fixed with respect to the inner housing during contact with the first and second lobes respectively; and, in the unlocked mode:

the shuttle pin is in a second location, different from the first location, in the passageway;

the first and second outer arms are arranged to contact the first and second cam lobes, respectively; and, the first and second outer arms are arranged to pivot with respect to the inner housing during contact with the first and second lobes.

7. The switching roller finger follower of claim 6, wherein:

in the locked mode the locking pin is in respective first positions within the first and second slots; and, in the unlocked mode the locking pin is in respective second positions, different from the respective first positions, in the first and second slots.

8. The switching roller finger follower of claim 6, further comprising:

a contact surface; and, a support portion arranged to pivotably connect the inner housing to a support element, wherein in the locked mode, the first and second cams are arranged to pivot the switching roller finger follower with respect to the support element to control contact of the contact surface with a valve stem for a valve train.

9. A switching roller finger follower, comprising:

an inner housing including:

a space at least partially formed by first and second side walls;

a locking barrel with a passageway; and, first and second slots passing through material forming the first and second side walls, respectively;

first and second outer arms pivotably connected to the first and second sides, respectively; and, a locking mechanism including:

a shuttle pin:

at least partially disposed in the passageway;

including a notch disposed in the space; and, displaceable within the passageway in a direction parallel to a longitudinal axis for the passageway;

a locking pin:

including a first outside diameter;

passing through the first and second slots and at least partly disposed in the notch;

displaceable within the first and second slots; and, including first and second ends extending past the first and second side walls, respectively; and, first and second locking sleeves:

separately formed from the locking pin;

fixedly secured to the first and second ends, respectively;

having second and third outside diameters, respectively; and, aligned with the first and second outer arms, respectively, in a direction orthogonal to a longitudinal axis for the locking pin.

10. The switching roller finger follower of claim 9, wherein the passageway includes a sealed first end and a second end opening into the space.

11. The switching roller finger follower of claim 9, wherein the shuttle pin is displaceable within the passageway to displace the locking pin within the first and second slots such that:

in a locked mode, the first and second locking sleeves contact the first and second outer arms, respectively; and, in an unlocked mode, the first and second locking sleeves are free of contact with the first and second outer arms, respectively.

12. The switching roller finger follower of claim 9, wherein the second outside diameter is different from the third outside diameter.

13. The switching roller finger follower of claim 9, wherein the second outside diameter is equal to the third outside diameter.

14. A method of fabricating a switching roller finger follower, comprising:

pivotably connecting first and second outer arms to an inner housing;

disposing a shuttle pin, including a portion with a notch, within a passageway formed by the inner housing;

disposing the notch within a space at least partly formed by the inner housing;

disposing a locking pin, with a first outside diameter, in first and second slots in the inner housing;

passing a portion of the locking pin through the notch;

extending first and second ends of the locking pin past the inner housing;

fixedly securing first and second locking sleeves to the first and second ends of the locking pin, respectively; and, aligning the first and second locking sleeves with the first and second outer arms, respectively, in a first direction orthogonal to a longitudinal axis for the locking pin, wherein:

second and third outside diameters for the first and second locking sleeves, respectively, are greater than the first outside diameter.

15. The method of claim 14 wherein:

disposing the shuttle pin within the passageway includes disposing the shuttle pin such that the shuttle pin is displaceable parallel to a longitudinal axis for the passageway; and, disposing a locking pin in the first and second slots includes disposing the locking pin such that the locking pin is displaceable within the first and second slots.

16. The method of claim 14 wherein the second outside diameter is different from the third outside diameter.

17. The method of claim 14 wherein the second outside diameter is equal to the third outside diameter.

18. The method of claim 14, wherein:

in an unlocked mode:

the shuttle pin is in a first position within the passageway;

the locking pin is in respective first positions within the first and second slots; and, the first and second locking sleeves are out of contact with the first and second outer arms, respectively; and, in a locked mode:

the shuttle pin is in a second position within the passageway; and, the locking pin is in respective second positions within the first and second slots; and, at least one of the first or second locking sleeves is in contact with the first or second outer arms, respectively.

* * * * *